US008607365B2

(12) United States Patent
Watley

(10) Patent No.: US 8,607,365 B2
(45) Date of Patent: Dec. 17, 2013

(54) SNAKE PROOF PROTECTIVE GARMENT

(75) Inventor: Bruce E. Watley, Centerville, IA (US)

(73) Assignee: Boyt Harness Company, LLC, Osceola, IA (US)

( * ) Notice: Subject to any disclaimer, the term of this patent is extended or adjusted under 35 U.S.C. 154(b) by 1430 days.

(21) Appl. No.: 11/465,922

(22) Filed: Aug. 21, 2006

(65) Prior Publication Data

US 2008/0040838 A1 Feb. 21, 2008

(51) Int. Cl.
*A41D 13/00* (2006.01)

(52) U.S. Cl.
USPC ..... 2/242

(58) Field of Classification Search
USPC ..... 2/24, 21, 242, 455, 16, 62, 911; 602/6, 602/26, 62; 128/881
See application file for complete search history.

(56) References Cited

U.S. PATENT DOCUMENTS

| | | | | |
|---|---|---|---|---|
| 4,382,301 | A | 5/1983 | Hightower, Jr. | |
| 4,660,223 | A * | 4/1987 | Fritch | 2/2.5 |
| RE32,506 | E | 9/1987 | Hightower, Jr. | |
| 4,716,594 | A | 1/1988 | Shannon | |
| 5,170,503 | A | 12/1992 | Hightower, Jr. et al. | |
| D382,673 | S | 8/1997 | Hargrove | |
| 5,983,391 | A * | 11/1999 | Palmer et al. | 2/16 |
| 5,987,778 | A | 11/1999 | Stoner | |
| 6,405,383 | B2 | 6/2002 | Heller et al. | |
| 6,675,394 | B2 * | 1/2004 | Egnew | 2/227 |
| 7,069,670 | B1 * | 7/2006 | Gerke | 36/2 R |
| 7,490,358 | B1 * | 2/2009 | Beck | 2/2.5 |

* cited by examiner

*Primary Examiner* — Tejash Patel
(74) *Attorney, Agent, or Firm* — Zarley Law Firm, P.L.C.

(57) ABSTRACT

A protective article of clothing adapted to protect snake fangs from biting into the leg of a wearer. The protective article has a leg portion that comprises a plurality of elongated inserts that are placed in overlapping side by side relation within a plurality of elongated pockets. The protective article of clothing wraps around a leg of an individual to protect the individual from being bitten by a snake.

6 Claims, 3 Drawing Sheets

SNAKE PROOF PROTECTIVE GARMENT

BACKGROUND OF THE INVENTION

The present invention is directed toward a protective article of clothing and more particularly to an article of clothing that protects the legs of a wearer from snake bites.

The use of protective legging is well-known in the art. In particular, hunters, hikers, and other outdoorsmen have used various protective leggings to protect against snake bites and thorny brush when walking through heavy undergrowth areas. For example, U.S. Pat. No. RE 32,506 by Hightower, Jr., incorporated by reference herein, teaches a tubular legging made of a basket weave material that protects against snake bites while being simple in form and construction, as well as less cumbersome to wear. In addition, U.S. Pat. No. 5,170,503 by Hightower, Jr. et al, incorporated by reference herein teaches a similar protective legging. While these garments improved on the art, problems still exist. For example, the tubular leg portion of the protective garments are not of a color or material that blends with the environment. Thus, a hunter who seeks protection from snake bites and thorny brush is unable to reduce visibility and detection by blending with the colors of the environment.

An additional problem in the art exists in the fact that a legging that is made of material capable of protecting one against a snake bite is usually very rigid and difficult to wrap around an individual's leg. Breaking the material into separate sections also is problematic as the joint created in between sections provides a weak spot wherein snakes are able to penetrate the protective garment and injure an individual wearing the garment.

Therefore, the primary objective of this invention is to provide a garment that protects against snake bites and thorny bushes and also blends with the environment.

Yet another object of the present invention is to provide added strength to a garment for enhanced protection.

These and other objectives will be apparent to those skilled in the art from the following description.

SUMMARY OF THE INVENTION

A protective article of clothing adapted to protect from snake fangs biting into the leg of a wearer. The protective article includes a leg portion having a plurality of elongated inserts made of material impervious to snake bites. The plurality of elongated inserts are placed into a plurality of elongated pockets that are within a fabric layer such that the elongated inserts overlap.

BRIEF DESCRIPTION OF THE DRAWINGS AND PHOTOS

Figure 1:
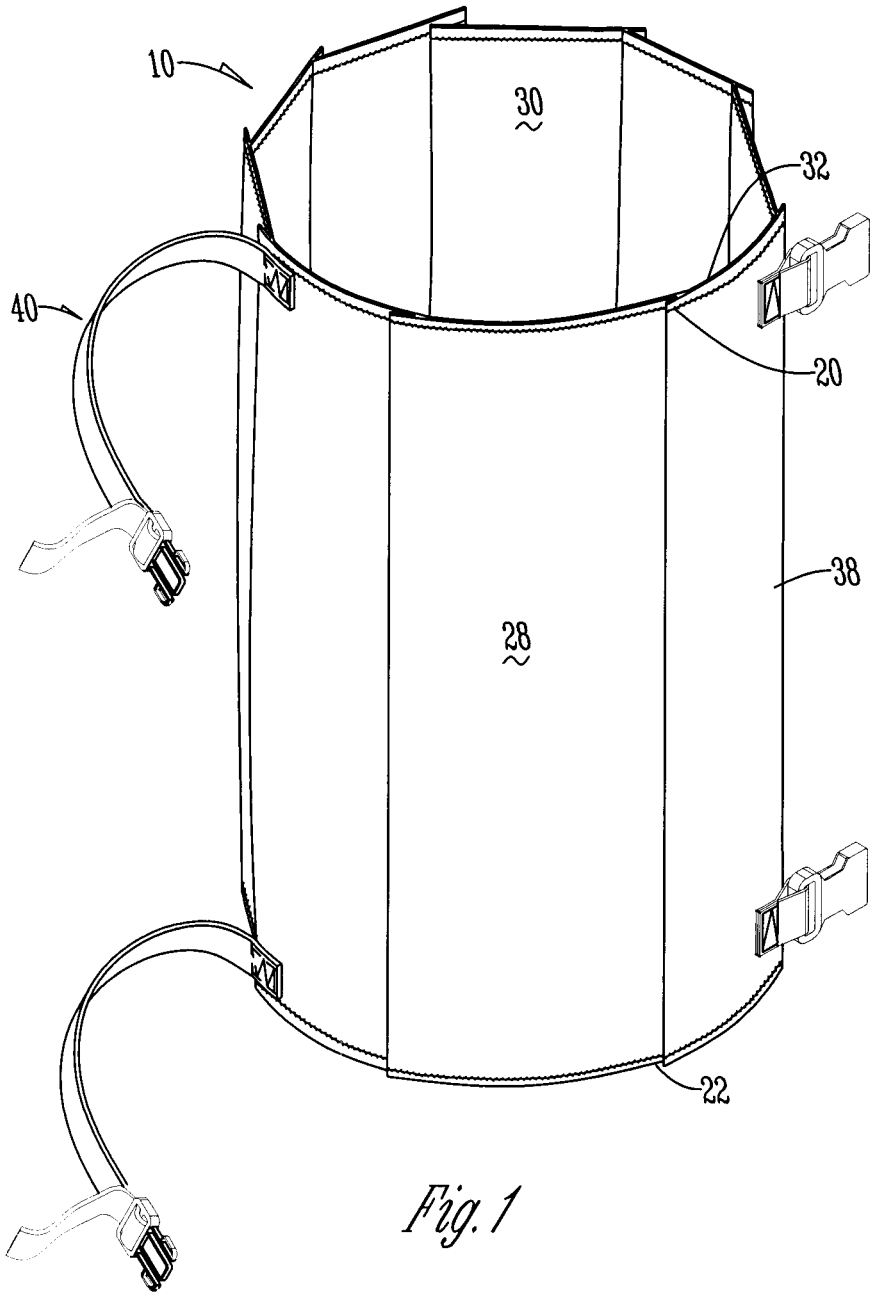
FIG. 1 is a perspective view of a protective garment.
Figure 2:
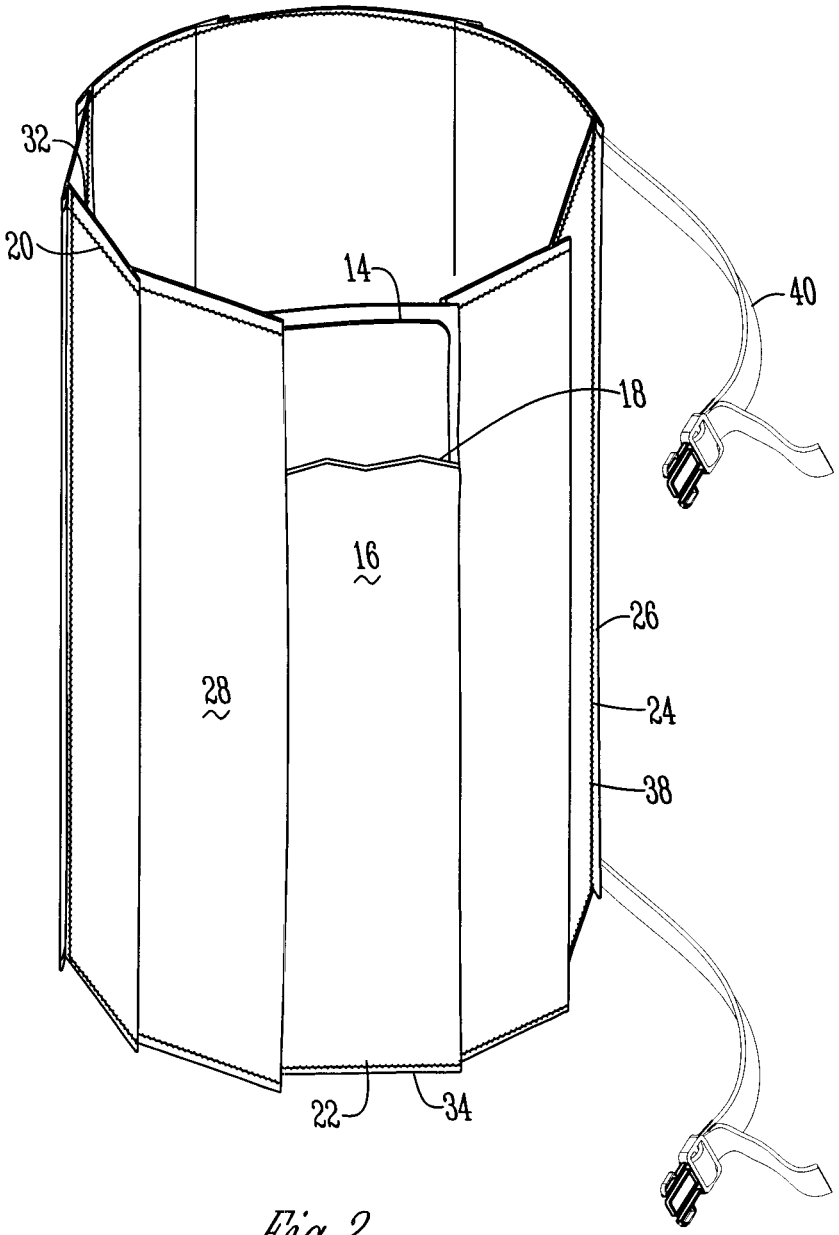
FIG. 2 is a perspective back view of protective garment.

DETAILED DESCRIPTION OF THE PREFERRED EMBODIMENTS,

As shown in the drawings, the protective article of clothing 10 is a legging or chap adapted to be worn on the leg of the wearer. While a chap is shown, it is understood that the article of clothing could be a gaiter, overalls, cover alls, or the like without. departing from the scope of the invention.

The chap 10 has a leg portion that comprises a plurality of elongated inserts made of a material impervious to a snake bite. For example, a protective sheet of aluminum or the like, a woven fabric with a plastic lining, a double layer of closely woven stainless steel mesh, plastic or the like.

The plurality of inserts 14 are disposed within a fabric layer 16 having a plurality of elongated pockets 18. The inserts 14 are disposed and held within the elongated pockets 18.

Each elongated pocket 18 has a top edge 20, bottom edge 22, first and second side edges 24, 26 that extend between and from the top and bottom edges 20, 22 and a front and back portions 28, 30. First and second lateral seams 32, 34 extend across and attach the top and bottom edges 20, 22 of the plurality of pockets 18 respectively.

Additionally, a plurality of longitudinal seams 38 secure the plurality of pockets together. The plurality of longitudinal seams 38 are positioned to cause the pockets 18 and thus inserts 14 to overlap with one another. Specifically, each longitudinal seam is located adjacent the second edge 26 in the front portion 28 of a first pocket and attaches to the back portion 30 adjacent the first edge 24 of a second pocket. Thus, because the front portion 28 of a first pocket is connected to the back portion 30 of a second pocket the pockets 18 are overlapping causing the inserts 14 therein to also overlap. By having overlapping inserts, not only is the chap 10 easily wrapped around a leg but additionally there is double protection at the longitudinal seams 38 to ensure that no weak points exist within the chap that may be penetrated by a snake bite.

The chap 10 additionally has a fastening means 40 thereon to secure the chap to a leg. Though depicted in the present embodiment as a buckle type fastener, additional fastening types such as hook and loop, zipper, button and the like are all contemplated as within the scope of this invention.

Figure 3:
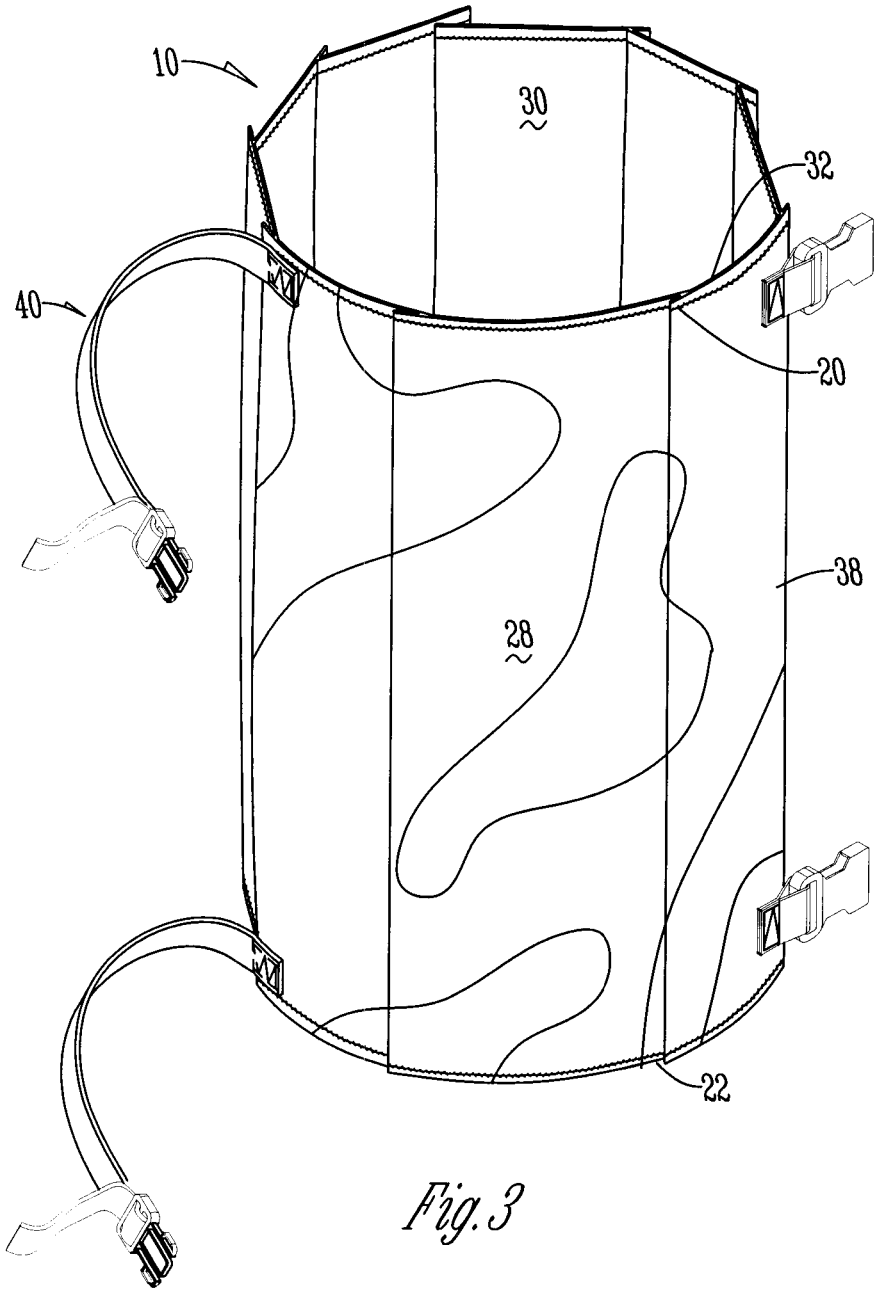
FIG. 3 is a perspective view of a protective garment.

Additionally, the fabric layer can be made of any color, preferred is a neutral earth tone color or camouflage print (FIG. 3). Thus, the wearer of the chap 10 blends into the brush causing fewer snakes to be aware of the presence of an individual and to bite the individual. Thus, at the very least all of the objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A protective article of clothing adapted to prevent snake fangs from biting into the leg of a wearer, comprising:

a leg portion having a plurality of elongated inserts made of material impervious to snake bites;

a fabric layer having a plurality of elongated pockets therein having a first edge, a second edge, a front portion, and a back portion that receive the plurality of elongated inserts; and a longitudinal seam attached to the second edge of the front portion of a first pocket and attached to the back portion adjacent the first edge of a second pocket such that the second edge of the first pocket overlaps the first edge of the second pocket.

2. The protective article of clothing of claim 1 wherein the seam connects a front portion of a first pocket to a back portion of a second pocket.

3. The protective article of clothing of claim 2 wherein the seam is in spaced relation to an adjacent edge of the second pocket.

4. The protective article of clothing of claim 1 wherein the material of the plurality of elongated inserts is plastic.

5. The protective article of clothing of claim 1 wherein the fabric layer is a neutral color.

6. The protective article of clothing of claim 1 wherein the fabric layer is of a camouflage print.

* * * * *